US012668910B2

(12) United States Patent
Di Maggio et al.

(10) Patent No.: US 12,668,910 B2
(45) Date of Patent: Jun. 30, 2026

(54) WASHING MACHINE AND METHODS FOR OPERATING A WASHING MACHINE

(71) Applicant: Henkel AG & Co. KGaA, Dusseldorf (DE)

(72) Inventors: Antonio Di Maggio, Schwaigern (DE); Arnd Kessler, Monheim/Rhein (DE); Ingo Hardacker, Hamminkeln (DE); Uwe Schaumann, Oberderdingen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 237 days.

(21) Appl. No.: 18/352,391

(22) Filed: Jul. 14, 2023

(65) Prior Publication Data

US 2024/0026592 A1 Jan. 25, 2024

(30) Foreign Application Priority Data

Jul. 21, 2022 (DE) ..... 10 2022 207 454.8

(51) Int. Cl.
*D06F 37/26* (2006.01)
*D06F 35/00* (2006.01)
(Continued)

(52) U.S. Cl.
CPC ..... *D06F 37/26* (2013.01); *D06F 35/006* (2013.01); *D06F 37/267* (2013.01);
(Continued)

(58) Field of Classification Search
CPC ..... D06F 37/26; D06F 37/267; D06F 35/006; D06F 39/10; D06F 39/12
See application file for complete search history.

(56) References Cited

U.S. PATENT DOCUMENTS 5,115,651 A 5/1992 Nukaga et al.
8,196,441 B2 * 6/2012 Hendrickson ..... D06F 39/022 68/17 R
(Continued)

FOREIGN PATENT DOCUMENTS

AT 281736 B 5/1970
DE 1786016 U 4/1959
(Continued)

OTHER PUBLICATIONS

Machine translation of FR-2604456-A1 to Grabarczyk. (Year: 1988).*
(Continued)

*Primary Examiner* — Joseph L. Perrin
(74) *Attorney, Agent, or Firm* — Bojuan Deng

(57) ABSTRACT

A washing machine has a drum-receiving container with a round drum therein, wherein the inner shape of the drum-receiving container is not round cylindrical. The drum accordingly has a radial distance along the circumferential direction thereof from the drum-receiving container, wherein the latter is configured such that this distance continuously varies in places and/or has no discontinuity. The distance is smaller in the uppermost region of the drum than at the mid-vertical height of the drum, and the distance is at its greatest in a lower region of the drum between a lowermost point of drum and one third of the vertical height of the drum. At the lowermost region, a breakaway edge may be formed below the drum to enable removal of externally adhering water.

21 Claims, 3 Drawing Sheets

(51) Int. Cl.
*D06F 39/08* (2006.01)
*D06F 39/10* (2006.01)
*D06F 39/12* (2006.01)

(52) U.S. Cl.
CPC ..... *D06F 39/083* (2013.01); *D06F 39/10* (2013.01); *D06F 39/12* (2013.01)

(56) References Cited

U.S. PATENT DOCUMENTS

| | | | | |
|---|---|---|---|---|
| 9,920,468 | B2 * | 3/2018 | Hendrickson | D06F 39/022 |
| 10,487,432 | B2 * | 11/2019 | Mikkelsen | D06F 37/264 |
| 10,584,435 | B2 * | 3/2020 | King | D06F 23/00 |
| 2004/0261195 | A1 | 12/2004 | Ghosh et al. | |
| 2005/0011234 | A1 * | 1/2005 | Kim | D06F 37/26 68/23 R |
| 2010/0000264 | A1 * | 1/2010 | Luckman | D06F 39/02 68/4 |
| 2018/0163336 | A1 * | 6/2018 | Unglenieks | D06F 39/12 |

FOREIGN PATENT DOCUMENTS

| | | | | |
|---|---|---|---|---|
| DE | 1585586 | A1 | 3/1972 | |
| DE | 29803522 | U1 | 7/1999 | |
| DE | 102014210626 | A1 | 12/2015 | |
| DE | 102016204347 | A1 | 9/2017 | |
| EP | 3219841 | A1 | 9/2017 | |
| FR | 2604456 | A1 * | 4/1988 | D06F 37/262 |
| WO | WO 2005/003268 | A1 | 1/2005 | |
| WO | 2019/182398 | A1 | 9/2019 | |

OTHER PUBLICATIONS

Extended European Search Report Mailed on Feb. 29, 2024 for EP Application No. 23195696, 22 page(s).

* cited by examiner

WASHING MACHINE AND METHODS FOR OPERATING A WASHING MACHINE

CROSS-REFERENCE TO RELATED APPLICATIONS

This application claims priority to German Application No. 10 2022 207 454.8, filed Jul. 21, 2022, the contents of which are hereby incorporated herein in its entirety by reference.

FIELD OF APPLICATION AND PRIOR ART

The invention relates to a washing machine and to methods for operating such a washing machine.

US 2004/0261194 A1 discloses a washing machine with what is known as a recirculation system, in which water is introduced not from the outside into a drum arranged in a drum-receiving container by partially flooding the drum receiving container, but instead with a line directly into the drum through an axis of rotation. A lower water level can thus be provided in the lower region of the drum-receiving container. As a result, the formation of suds, in particular between drum-receiving container and drum, can be reduced.

EP 3 219 841 A1 discloses a washing machine which suffers the problem of suds being formed during the spinning of a drum. This results in a further problem for pumping out washing liquor which contains very many suds. This can lead to a reduction in the drive power of a pump in the washing machine for pumping out and in the efficiency of the pump. In addition, it is very difficult to pump out the suds which disrupts the progress of the washing.

OBJECT AND ACHIEVEMENT THEREOF

The object of the present invention is to provide a washing machine as stated above and a method for the operation thereof as stated above, with which prior art problems can be solved and which make it in particular possible to efficiently operate a washing machine and preferably to reduce the formation of suds during a washing process or during spinning.

Said object is achieved by a washing machine having the features of Claim 1 and by a method for the operation thereof having the features of Claim 17, 20 or 21. Advantageous and preferred embodiments of the invention are the subject matter of further claims and are explained in greater detail in the following. Some of the features are described only for the washing machine or for a method. They are, however, intended to apply by themselves and independently of one another both to such a washing machine and to such a method. The wording of the claims is incorporated by express reference into the content of the description.

The washing machine has a drum for washing laundry therein, wherein the drum is arranged rotatably about an axis of rotation in a drum-receiving container. Such a drum-receiving container is generally also referred to as a tub. The washing machine furthermore has a water routing system with a water inlet from an external water supply into the washing machine, with water lines and valves and with a water outlet out of the washing machine. An input device for water into the drum is provided, as is/are one or two container drains at the bottom of the drum-receiving container, through which water can drain out of the drum-receiving container. The washing machine also has a pump which is connected by way of water lines on the one hand to the container drain(s) and on the other hand to the input device; it may optionally also have an integrated heating means. It also has a washing machine controller which is connected to the pump and advantageously also to further functional units.

According to the invention, the outer shape of the drum is round cylindrical or round and may preferably even extend circularly about an axis of rotation of the drum. In contrast, the inner shape of the drum-receiving container is not round cylindrical or is not round, such that, along a circumferential direction of the drum, the drum has a radial distance from the drum-receiving container, wherein the drum-receiving container is configured such that this distance continuously varies in places and/or has no discontinuity. The distance is smaller in the uppermost region of the drum than at the mid-vertical height of the drum. The distance is at its greatest in a lower region of the drum between the lowermost point of the drum and one third of the vertical height of the drum, i.e. approximately in the lower third of the drum-receiving container. The distance is smaller at the lowermost point of the drum than in the lower region of the drum which is located vertically above the lowermost point or upwardly adjoins the latter. The distance between the drum and drum-receiving container is at its greatest in the circumferential direction up- and downstream of the lowermost point, each one of the container drains from the drum-receiving container being arranged there.

Thanks to this configuration of the distance between drum and drum-receiving container, it is possible to reduce undesirable formation of suds, since water and any suds formed can first and foremost be collected in the lower region due to the relatively greater distance. Collecting water first and foremost also ensures that its volume around the drum can be reduced or the water can be quickly evacuated downward between the drum and drum-receiving container and optionally drained and can therefore contribute less to the formation of suds.

In one development of the invention, it may be provided that, on the inside of the drum-receiving container, at least one breakaway edge or an upwardly curved breakaway body for water located on the outside of the drum is formed in the lower region or at the lowermost point of the drum, or that the drum-receiving container has such a breakaway edge, preferably as a separately formed and fastened part. The distance between the drum-receiving container and drum may be at its smallest at the breakaway edge or at the breakaway body, wherein this distance may particularly advantageously amount to 5 mm to 20 mm. It may also amount to less than 5 mm but, if suspension of the drum is desired, it should not be too small to ensure that the drum cannot in any event rub or strike against the drum-receiving container. The water on the outside of the rotating drum, which is entrained by the rotation and is, as it were, co-rotated on the outside as an adhering film of water, can be stripped of at the breakaway edge. If the breakaway edge is arranged close to a container drain, advantageously at a distance of less than 10 cm or less than 5 cm, the water may also immediately drain away and is thus removed and thus cannot in any event contribute to the formation of suds. A container drain is advantageously arranged upstream of the breakaway edge in the direction of rotation of the drum.

In one development of the invention, the breakaway edge may be mirror-symmetrical, in particular with respect to a vertical mirror axis. The vertical minor axis may extend through the axis of rotation. Such a symmetrical breakaway edge means that the same effect can be achieved whichever the direction of rotation of the drum. In this case, it is preferably provided that a container drain is provided upstream of and at the above-stated small distance from both sides of the breakaway edge.

A valve may advantageously be arranged at one or each container drain on the drum-receiving container, particularly advantageously one at each of two container drains. These valves can seal the drum-receiving container in watertight and airtight manner. Alternatively, just one single valve may be provided for the two container drains or all the container drains. For this purpose, the container drains can be merged somewhat below the drum-receiving container and then continue to the valve.

In one possible further development of the invention, the drum-receiving container may be shape-modifiable at least in the lower region, whereby the distance from the drum can be varied over time in controlled manner. The container may accordingly be modified to suit it for possible measures for reducing or avoiding the formation of suds. To this end, the drum-receiving container or the wall thereof may, at least in the lower region, include or consist of a non-rigid material. Such material may advantageously be a resilient plastics material or rubber, which also facilitates sealing. The shape of the drum-receiving container with regard to its distance from the drum, in particular in the lower region, can be modified by way of actuators. This may in particular proceed in the region of the above-stated breakaway edge, such that the shape of this breakaway edge may optionally also be modified. For example, it may be small or even not present at all when it is not needed, for example because there is no risk of suds forming or little water is being used during the current stage of the washing process. If, on the other hand, suds are observed to be forming or a very large volume of water is being used, it can be made larger or higher in the direction of the drum in order to strip off water on the outside. This can be done continuously, as a function of the required effect. Alternatively, it may be done in two steps or even in just one step to simplify control and/or actuator systems. The washing machine controller may preferably assume such control. The actuator system or individual actuators are advantageously electrically operated, either by way of an electromagnet or electric motor.

In one development of the invention, a filter may be arranged downstream of the container drain and upstream of the pump, advantageously downstream of an above-stated valve, which may particularly advantageously be arranged close to the container drain or directly downstream thereof. This allows water emerging from the drum-receiving container to be filtered, in particular before it reaches the pump where it might cause problems. Such filters are known in washing machines. The filter may also be backflushable. A filter advantageously has a filter housing and a filter element therein.

In a further advantageous development of the invention, the washing machine has a dispensing means for substances providing a washing action. This may be part of the water routing system or be connected thereto. It may be a known drawer in the upper region of the washing machine, and the substances providing a washing action can be rinsed onward by water flowing therethrough on its way into the drum-receiving container or into the drum. Alternatively, a dispensing means may also be arranged in a water path between the drum-receiving container or container drain and pump, which so enables particularly good and efficient mixing with water.

In a further development of the invention, a valve can be arranged at the container drain on the drum-receiving container, which valve seals the drum-receiving container in watertight and airtight manner, in particular water may or may not be drained off through it from the bottom of the drum-receiving container. In the upper region of the drum-receiving container is provided an air inlet which is closable in airtight manner by way of an air inlet valve. Alternatively or additionally, one or more nonreturn valves, optionally with different conducting directions, may also be provided here at the air inlet.

The air inlet in the upper region of the drum-receiving container advantageously has a cross-section which is greater than the sum of all the cross-sections of the container drains at the bottom of the drum-receiving container. Accordingly, suds can, for example be evacuated to the air inlet and, possibly, even be entirely removed from the washing machine.

The air inlet may preferably be arranged in the upper third of the drum-receiving container, preferably in the upper fifth. It may particularly preferably be arranged at the uppermost point of the drum-receiving container.

At least one nonreturn valve is advantageously provided in or at the upper region of the drum-receiving container or at the stated air inlet. Such a nonreturn valve may be configured to let air, water or suds out of the drum-receiving container, in particular through to the water outlet. The conducting direction of the nonreturn valve is then out of the drum-receiving container. Such suds are then no longer troublesome, in particular if they can be removed from the washing machine via the water outlet. Discharging air may also be advantageous, in particular in order to avoid "pumping" within the washing machine due to rapidly changing pressure conditions. These may arise when the drum is set in motion during rapid rotation, for example during spinning, due to an imbalance.

An alternative or possibly further nonreturn valve may be configured to allow air to pass therethrough into the drum-receiving container. Its conducting direction is then into the drum-receiving container. Preferably, precisely two nonreturn valves, which are particularly advantageously oppositely configured and arranged, are provided in the upper region of the drum-receiving container. They thus have opposing conducting directions.

A cross-sectional constriction within a nonreturn valve or nonreturn throttle valve can advantageously have a fixed setting or be controllable. If the flow diameter or cross-section is variable, the nonreturn valve is controllable or adjustable. In controlled nonreturn valves or nonreturn throttle valves, the cross-section is determined by a reference variable. A combination of air inlet nonreturn valve and throttle may be provided here.

If only a static reduction in flow diameter is involved, the nonreturn throttle valve is described as uncontrolled. Optimum adaptation to the particular application is achieved by varying the different sizes (e.g. length and diameter) of the throttle nonreturn valve.

In one development of the invention, a flow cross-sectional area of the two nonreturn valves may differ. Provision may be made for a flow cross-sectional area of a first nonreturn valve with a conducting direction out of the drum-receiving container to be greater than a flow cross-sectional area of a second nonreturn valve with a conducting direction into the drum-receiving container.

In a method according to the invention for operating an above-described washing machine with a shape-modifiable breakaway edge, the shape thereof can generally be modified in order to influence the removal of water and/or suds from the outside of the drum during the rotation thereof. The breakaway edge may here be moved toward the drum or made higher in order to remove more water from the outside of the drum. The breakaway edge may be moved away from the drum or made smaller in order to remove less water from the outside of the drum, for example because this has been identified as necessary or advantageous. The shape or height of the breakaway edge can be modified in steps or continuously as previously explained.

It may further be provided that valves at the container drains be entirely or at least 50% closed in order to reduce suds in the drum. This can be carried out by the washing machine controller.

In a further development of the invention, water may be temporarily stored in the above-described filter and introduced into the drum by the pump as required. The filter may to this end have a relatively large volume. It is thus possible to prevent the pump from running or starting up dry.

In a method for operating an above-described washing machine with an air inlet in the upper region of the drum-receiving container, a valve at the at least one container drain out of the drum-receiving container may be opened for pumping water out of the drum-receiving container. Advantageously, the air inlet valve in the upper region of the drum-receiving container is additionally opened, which can also be effected by appropriately configured nonreturn valves or by the nonreturn valve with a conducting direction into the drum-receiving container.

A valve at the at least one container drain may be entirely or at least 50% closed in order to reduce suds in the drum, which would be troublesome for and negatively impact the washing process. This prevents the suds from spreading further in the system or in the water routing system, in particular not in the direction of the pump. Stable pump operation can thus be continued.

These and further features are revealed in the description and in the drawings as well as in the claims, wherein the individual features can each be realized singly or severally in the form of sub-combinations in one embodiment of the invention and in other fields, and can represent embodiments advantageous and protectable per se, for which protection is claimed here. The subdivision of the application into individual sections and sub-headings does not limit the statements made thereunder in their general validity.

BRIEF DESCRIPTION OF THE DRAWINGS

Further advantages and aspects of the invention are revealed by the claims and the description of exemplary embodiments of the invention, which are explained below with reference to the figures, in which:

DETAILED DESCRIPTION OF THE EXEMPLARY EMBODIMENTS

Figure 1:
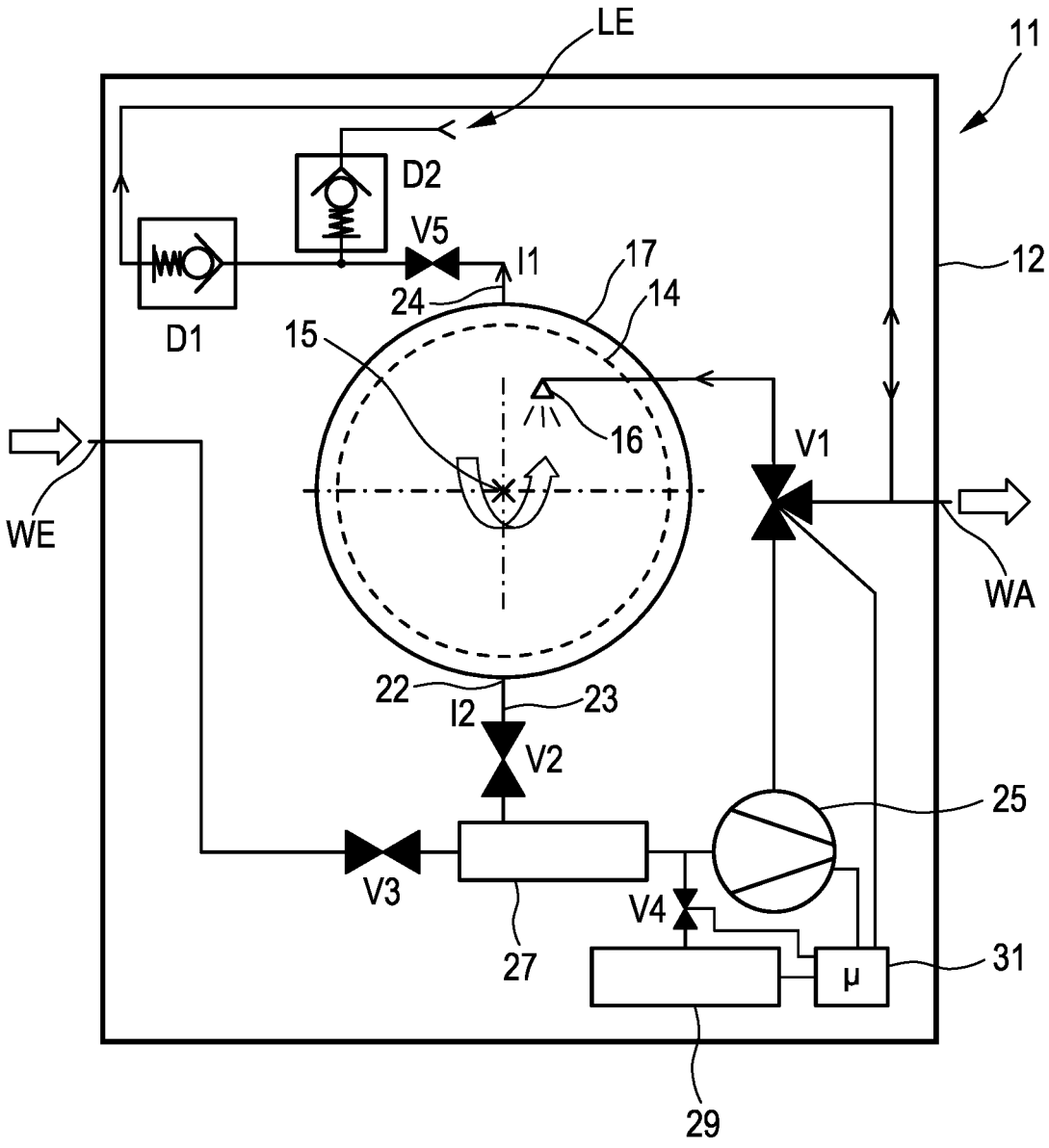
FIG. 1 is a schematic representation of a washing machine according to the invention.
Figure 2:
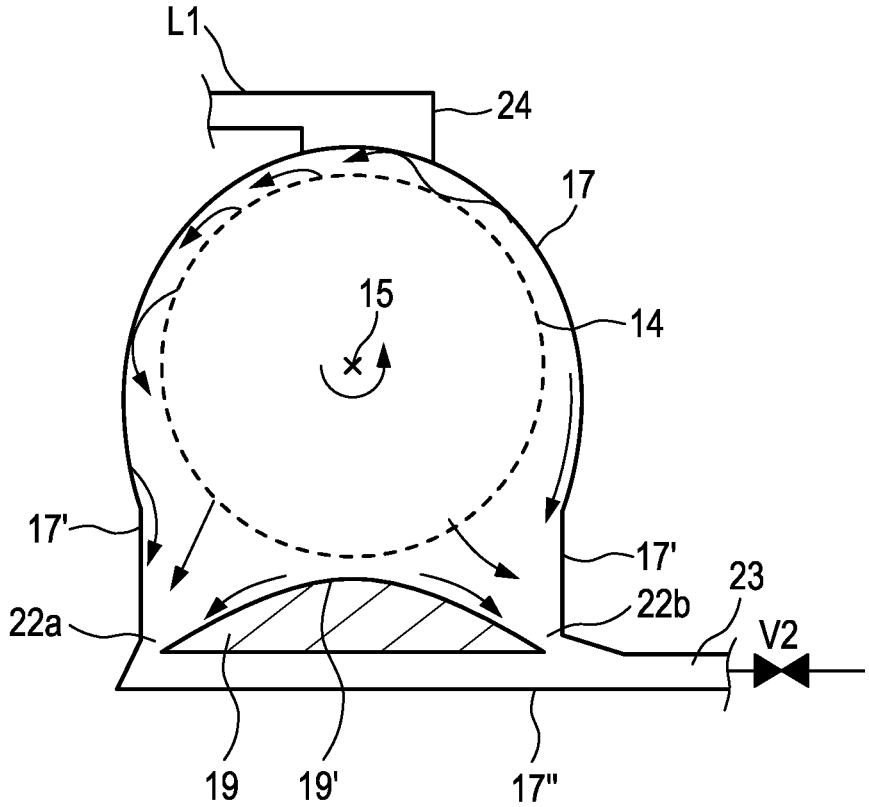
FIGS. 2 to 4 are enlarged representations of various variants of the drum-receiving container with drum.

FIG. 1 is a greatly simplified representation of a washing machine 11 according to the invention with a housing 12. The washing machine 11 has a rotatable drum 14 with an axis of rotation 15 which is arranged within a drum-receiving container 17. FIG. 2 shows an enlarged view of the drum-receiving container 17. It has a lower region 17' which transitions downward into a bottom 17". Just above the bottom 17" and directly below the drum 14, there is a breakaway body 19 which is upwardly curved. An upper edge 19' forms as it were a breakaway edge as stated above. It is apparent that the breakaway body 19 is mirror-symmetrical with respect to a vertical mirror axis, but this need not be the case.

The washing machine 11 has a water inlet WE and a water outlet WA. A water routing system has a plurality of water lines 1 in the interior of the washing machine 11, in which five valves V1 to V5 are also arranged. A water line leads from valve V1 to a spray nozzle 16 within the drum-receiving container 17 or within the drum 14 for introducing or spraying water into the drum 14. A container drain 22 on a water line 12 leads to a valve V3 which is connected to a filter 27. The water inlet WE is connected to the filter 27 by way of a valve V3. By way of a further water line, the filter 27 is connected to a pump 25 which in turn is connected by way of a water line to the valve V1. A dispensing means 29 introduces substances providing a washing action into the water line between filter 27 and pump 25 by way of a valve V4. This is known from the prior art and need not be explained further; the apportioning of substances providing a washing action is not the subject matter of the present invention. In addition to its filtering function, the filter 27 may also serve as a volume of water for recirculating water from the drum 14 or from the drum-receiving container 17.

At the top of the drum-receiving container 17, there is a top air inlet 24 which leads by way of a water line 11 and an air inlet valve V5 to two nonreturn valves D1 and D2. The nonreturn valve D1 allows water, air and suds to pass in a direction away from the drum 14 or drum-receiving container 17, but not in the opposite direction. A corresponding water line leads to the water outlet WA. The nonreturn valve D2 allows air to pass through in the direction of the drum-receiving container 17, in particular for pressure equalization or venting. This air is drawn in through an air inlet LE which opens into the interior of the washing machine 11. Since the machine's housing 12 is obviously not airtight, air may accordingly be drawn in from the outside. Air, water or suds cannot emerge in the opposite direction due to the nonreturn function. The two nonreturn valves D1 and D2 here operate in opposite directions, i.e. with opposing conducting directions. In this way, pressure can be equalized in the drum-receiving container 17 and furthermore upwardly emerging suds can be evacuated through the nonreturn valve D1 to the water outlet WA. The air inlet valve V5 may be used to close the top air inlet 24, in particular to close it overall in airtight manner. If the air inlet valve V5 is opened, the two nonreturn valves D1 and D2 can operate in opposite directions. A flow cross-sectional area of the nonreturn valve D1 is greater than a flow cross-sectional area of the nonreturn valve D2. In this way, it is in particular possible for voluminous suds to be better evacuated through nonreturn valve D1, while actually only air has to be able to gain access to the system through nonreturn valve D2.

The air inlet valve V5 may be used to close the top air inlet 24, in particular to close it overall in airtight manner. If the air inlet valve V5 is opened, the two nonreturn valves D1 and D2 can operate in opposite directions. A flow cross-sectional area of the nonreturn valve D1 is greater than a flow cross-sectional area of the nonreturn valve D2. In this way, it is in particular possible for voluminous suds to be better evacuated through nonreturn valve D1, while actually only air has to be able to gain access to the system through nonreturn valve D2.

A controller 31 is connected to the pump 25, the dispensing means 29 and the valve V4 and, in a manner which is not shown, also to the other valves for controlling them. The controller 31 can also be connected to an operating means (not shown) for the washing machine and optionally to inverter electronics for a drum drive motor.

During the washing process, the drum 14 rotates and washing liquor, i.e. water combined with substances providing a washing action, is sprayed into the drum 14 via the spray nozzle 16. The composition of the washing liquor can be set by the controller 31 via the dispensing means 29. At the valve V1, it is possible to set whether the washing liquor is introduced into the drum 14 or pumped out of the washing 11 via the water outlet WA. The valve V2 makes it possible to shut off water flow from the drum 14 via the container drain 22 back into the filter 27 and thus back into the circuit.

The nonreturn valve D1 serves to prevent air, water or suds from escaping from the drum 14 or from the drum-receiving container 17 to the outside via the top air inlet 24, the line 11 and the valve V5 if there is excess pressure or too many suds in the drum 14 or in the drum-receiving container 17. This excess of suds can make it necessary to stop the washing process until the suds slowly break down or collapse. Operating the pump 25 with too many suds in the circuit is not possible or at least highly problematic. Air, water or suds can also be discharged to the water outlet WA. The nonreturn valve D2 is shut off in this case. This is because nonreturn valve D2 which operates in the opposite direction allows air into the drum-receiving container 17 or into the drum 14. In this way, a reduced pressure therein can be equalized. Air, water or suds cannot, however, emerge here. If suds are formed during the washing process, for example due to incorrect dispensing of laundry detergents, an excessive rotational speed or possibly too small a volume of laundry in the drum 14, i.e. due to excessively intense mechanical laundering action caused on the one hand by excessively high rotational speed of the drum 14 and/or on the other hand by too small a laundry load, the suds can escape to the outside via the line 11 through the nonreturn valve D1 when the air-inlet valve V5 is open. In particular, the suds escape into the water line to the water outlet WA. The valve V2 can assist this process by being closed or by air flow being controlled as a function of a volume of laundry in the drum 14, a rotational speed of the drum 14 and the volume of water present in the system.

The top air inlet 24 is configured so as to facilitate outflow of suds. Flow areas at the bottom of the drum-receiving container 17 may thus be smaller in total than in the upper region or at the top air inlet 24. The flow of water or air may additionally be controlled via the valves V2 and V5.

In order to achieve a stable state, fresh water can be supplied from outside at the water inlet WE via the valve V3. Some of the washing liquor can also alternately be removed from the system through the water outlet WA via valves V2 and V1 by way of the pump. The concentration of laundry detergents in the water in the system can also be adjusted in this manner. In parallel, the rotational speed of the drum 14 can be reduced and the pump 25 can be used exclusively for pumping away suds or washing liquor.

Once the suds have been sufficiently reduced, air exchange may again be achieved via the nonreturn valve D2 alone. At this point, nothing any longer needs to escape from the drum-receiving container 17 through the nonreturn valve D1.

The enlarged representation of FIG. 2 shows the non-circular shape of the drum-receiving container 17 more clearly. The distance between the inside of the drum-receiving container 17 and the drum 14 is at its smallest in the upper region below the top air inlet 24, but increases evenly to the left and right. In the lower region 17' of the drum-receiving container 17, the distance is approximately twice that at the top. Due to the specific way the drum-receiving container 17 is shaped in this lower region 17', the distance rapidly becomes very much greater before the lower region 17' transitions into the bottom 17". The breakaway body 19 is located on this bottom 17". The breakaway edge formed by the upper edge 19' results, as shown by the arrows illustrating water flow, in water being more strongly removed from the outside of the drum 14 as was explained above. That is the function of a breakaway edge. This water previously reaches the outside through small orifices, as are known to be present, in the drum 14. Container drains 22*a* and 22*b*, which are merged into a drain line 23, are accordingly formed on the left-hand and right-hand sides of the breakaway body 19. As previously explained, valve V2 is located in one of these drain lines 23. Water can accordingly be purposefully discharged from the drum-receiving container 17, but air can possibly also be admitted or discharged.

Figure 3:
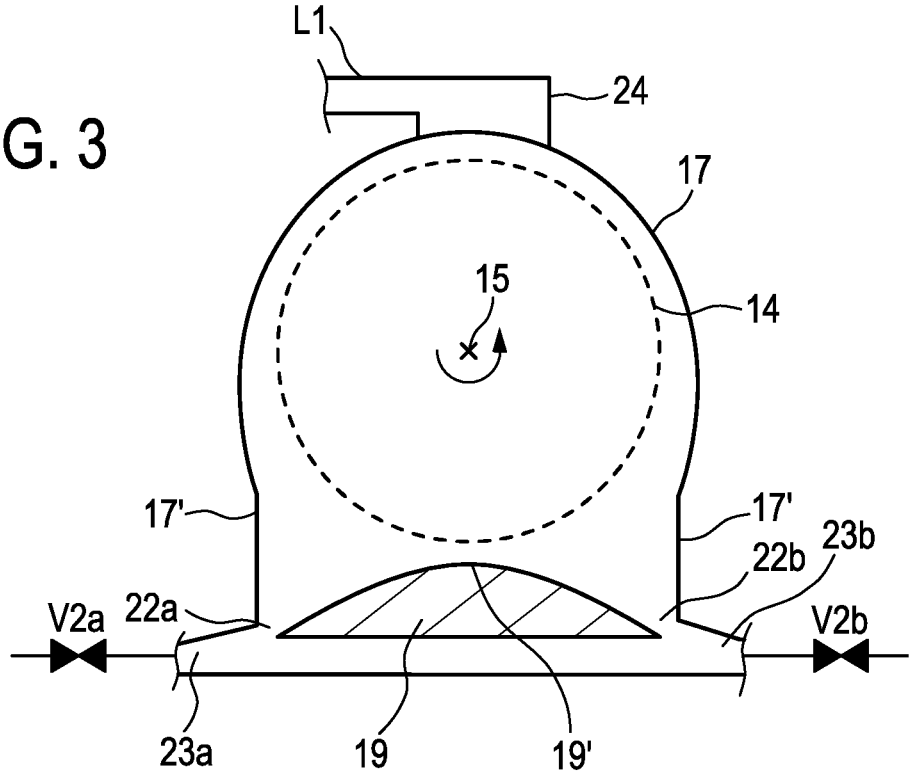

FIG. 3 shows a similar structure for a drum-receiving container 17, wherein two drain lines 23*a* and 23*b*, each having a valve V2*a* and V2*b*, are here provided in the lower region 17' downstream of the container drains 22*a* and 22*b*. Further functionalities can be achieved by such separate drainage.

It should also be noted with regard to the breakaway body 19 that the drum 14 is of round cylindrical or circular cylindrical construction extending into the plane of the drawing. Similarly, the breakaway body 19 should have a cylindrical or constant cross-section in the direction parallel to the axis of rotation 15. The distance between the breakaway body 19 or the upper edge 19' on the one hand and the drum 14 on the other hand is thus always the same.

Figure 4:
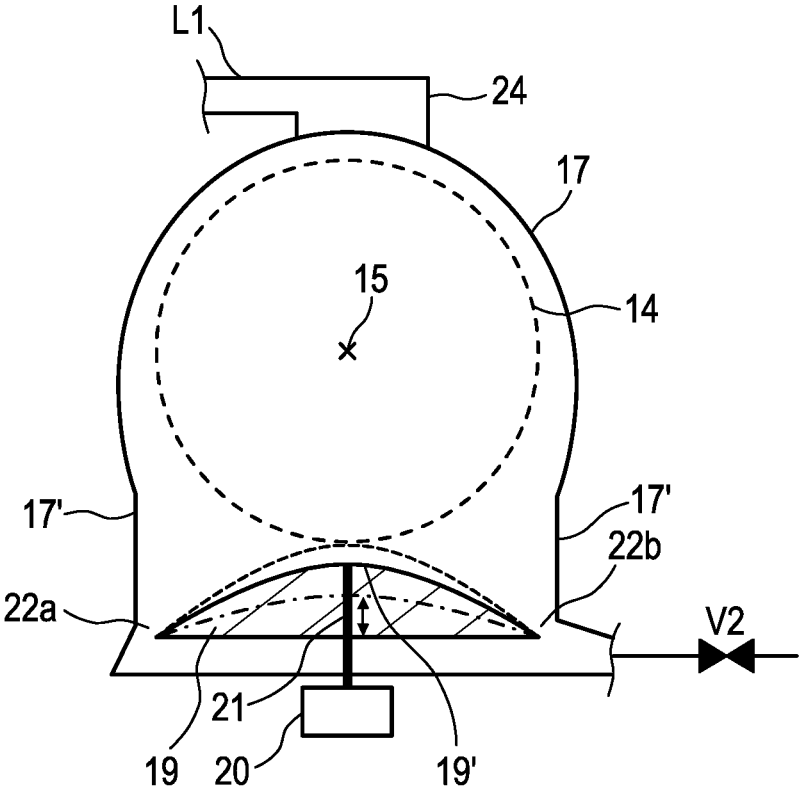

FIG. 4 shows a further alternative development of the invention based on the representation of FIG. 2. The shape of the drum-receiving container 17 is the same as previously described. The breakaway body 19, on the other hand, is adjustable or modifiable, in particular modifiable in height. This can be achieved by an adjustment actuator 20 being connected to the upper edge 19' by way of an adjustment rod 21. In this way, it can be formed into an upwardly curved shape, shown in dashed lines, in which it is very close to the drum 14. This distance may here be 5 to 15 mm. The adjustment actuator 20 can correspondingly also move the upper edge 19' downward by way of the adjustment rod 21, so making the breakaway body 19 flatter, for example in the shape shown in dash-dotted lines. The distance from the drum 14 is then greater than for example in the upper region of the drum 14. The adjustment actuator 20 can to this end be appropriately controlled by the controller 31. It may have an electric motor or electromagnet for actuation.

The invention claimed is:

1. A washing machine having:

a drum for washing laundry therein, a drum-receiving container in which said drum is arranged rotatably about an axis of rotation, a water routing system which has:

a water inlet from an external water supply into said washing machine, water lines and valves, a water outlet from said washing machine, an input device for water into said drum, at least one container drain at a bottom of said drum-receiving container, a pump which is connected by way of water lines to said at least one container drain and to said input device, a washing machine controller to which said pump is connected, wherein:

an outer shape of said drum is round cylindrical or round, an inner shape of said drum-receiving container is not round cylindrical or not round, along a circumferential direction of said drum, said drum has a radial distance from said drum-receiving container, wherein said drum-receiving container is configured such that said distance:

continuously varies in places and/or has no discontinuity, is smaller in an uppermost region of said drum than at a mid-vertical height of said drum, is at its greatest in a lower region of said drum between a lowermost point of said drum and one third of a vertical height of said drum, is smaller at said lowermost point of said drum than in said lower region of said drum which is located vertically above said lowermost point, between said drum and said drum-receiving container is at its greatest in a circumferential direction up-and downstream of said lowermost point, said at least one container drain from said drum-receiving container being arranged here wherein:

a breakaway edge for water located on an outside of said drum is formed in said lower region or at said lowermost point of said drum on an inside of said drum-receiving container, and said distance from said drum-receiving container to said drum is at its smallest at said breakaway edge.

2. The washing machine as claimed in claim 1, wherein said breakaway edge is mirror-symmetrical with respect to a vertical mirror axis, wherein said vertical mirror axis extends through an axis of rotation.

3. The washing machine as claimed in claim 1, wherein:

said at least one container drain comprises two container drains, a valve is arranged at each of said two container drains on said drum-receiving container, and each valve seals said drum-receiving container in a watertight and airtight manner.

4. The washing machine as claimed in claim 1, wherein said drum-receiving container is shape-modifiable in said lower region, wherein said drum-receiving container includes or consists of non-rigid material in said lower region, wherein said shape of said drum-receiving container is modifiable with regard to a distance of said drum-receiving container from said lower region of said drum by way of actuators.

5. The washing machine as claimed in claim 4, wherein said actuators are electrically operated.

6. The washing machine as claimed in claim 1, wherein said shape of said drum-receiving container is modifiable with regard to a distance of said drum-receiving container from said lower region of said drum by way of actuators in a region of said breakaway edge.

7. The washing machine as claimed in claim 1, wherein a filter is arranged downstream of said container drain and upstream of said pump.

8. The washing machine as claimed in claim 1, wherein a dispensing means is provided for substances providing a washing action which is part of said water routing system or is connected to said water routing system.

9. The washing machine as claimed in claim 1, wherein a valve is arranged at said at least one container drain on said drum-receiving container, which valve seals said drum-receiving container in watertight and airtight manner, an air inlet is arranged in an upper region of said drum-receiving container, said air inlet is closable in airtight manner by way of an air inlet valve.

10. The washing machine as claimed in claim 9, wherein said air inlet in said upper region of said drum-receiving container has a cross-section which is greater than or equal to a sum of all cross-sections of said at least one container drain at said bottom of said drum-receiving container.

11. The washing machine as claimed in claim 9, wherein said air inlet is arranged in an upper third of said drum-receiving container or at an uppermost point of said drum-receiving container.

12. A method for operating said washing machine as claimed in claim 9, said method comprising opening said valve at said at least one container drain out of said drum-receiving container for pumping water out of said drum-receiving container, and, in addition, opening said air inlet valve in said upper region of said drum-receiving container.

13. A method for operating said washing machine as claimed in claim 9, said method comprising closing said valve at said at least one container drain entirely or by at least 50% to reduce suds in said drum.

14. The washing machine as claimed in claim 1, wherein at least one nonreturn valve is provided at an upper region of said drum-receiving container, wherein one said nonreturn valve allows air and/or suds to pass therethrough out of said drum-receiving container.

15. The washing machine as claimed in claim 14, wherein a further nonreturn valve is provided at said upper region of said drum-receiving container, which further nonreturn valve allows air to pass therethrough into said drum-receiving container.

16. The washing machine as claimed in claim 14, wherein said washing machine has precisely two nonreturn valves, wherein said two nonreturn valves are oppositely arranged and provided in said upper region of said drum-receiving container.

17. The washing machine as claimed in claim 14, wherein said washing machine has precisely two nonreturn valves, wherein a flow cross-sectional area of said two nonreturn valves is different, wherein a flow cross-sectional area of one nonreturn valve of said two nonreturn valves with a conducting direction out of said drum-receiving container is greater than a flow cross-sectional area of the other one nonreturn valve of said two nonreturn valves with a conducting direction into said drum-receiving container.

18. A method comprising:

providing the washing machine of claim 1, modifying a shape of said breakaway edge, and thereafter rotating said drum such that said modified shape of said breakaway edge influences removal of water from said outside of said drum during a rotation of said drum.

19. The method as claimed in claim 18, further comprising:

moving said breakaway edge toward said drum in order to remove more water from said outside of said drum, and moving said breakaway edge away from said drum in order to remove less water from said outside of said drum.

20. The method as claimed in claim 18, further comprising closing said at least one valve at said at least one container drain entirely or by at least 50% closed to reduce suds in said drum.

21. The method as claimed in claim 18, further comprising temporarily storing water in a filter and introducing the water into said drum by said pump.

* * * * *